US008826476B2

(12) United States Patent
Szeinberg et al.

(10) Patent No.: US 8,826,476 B2
(45) Date of Patent: Sep. 9, 2014

(54) SYSTEM AND METHOD FOR PREVENTING PRESSURE ULCERS

(71) Applicants: Jorge Szeinberg, D.N. Hof Ashkelon (IL); Miguel Benito Derfel, Ashkelon (IL)

(72) Inventors: Jorge Szeinberg, D.N. Hof Ashkelon (IL); Miguel Benito Derfel, Ashkelon (IL)

( * ) Notice: Subject to any disclaimer, the term of this patent is extended or adjusted under 35 U.S.C. 154(b) by 0 days.

(21) Appl. No.: 13/623,193

(22) Filed: Sep. 20, 2012

(65) Prior Publication Data

US 2013/0312191 A1 Nov. 28, 2013

(30) Foreign Application Priority Data

May 24, 2012 (IL) ..... 219995

(51) Int. Cl.
*A47C 20/00* (2006.01)

(52) U.S. Cl.
USPC ..... 5/632; 5/933; 5/944; 5/731; 5/736

(58) Field of Classification Search
USPC ..... 5/600, 613, 616, 617, 618, 731, 736, 5/944, 933
See application file for complete search history.

(56) References Cited

U.S. PATENT DOCUMENTS

| | | | | |
|---|---|---|---|---|
| 1,318,271 | A * | 10/1919 | Ford | 5/600 |
| 2,904,036 | A | 9/1959 | Thomas | |
| 3,656,190 | A * | 4/1972 | Regan et al. | 5/613 |
| 3,810,263 | A * | 5/1974 | Taylor et al. | 5/81.1 C |
| 4,267,610 | A * | 5/1981 | Blakeway et al. | 5/613 |
| 4,852,712 | A * | 8/1989 | Best | 193/35 TE |
| 5,147,025 | A * | 9/1992 | Flippo | 198/782 |
| 2001/0047543 | A1* | 12/2001 | VanSteenburg et al. | 5/81.1 C |
| 2002/0023297 | A1* | 2/2002 | Khait | 5/600 |
| 2010/0218315 | A1* | 9/2010 | Hyde et al. | 5/613 |
| 2011/0225727 | A1* | 9/2011 | McGee | 5/81.1 C |

FOREIGN PATENT DOCUMENTS

| | | | |
|---|---|---|---|
| AU | 512454 | B2 | 6/1977 |
| DE | 102005015305 | A1 | 10/2006 |
| EP | 0329644 | A2 | 8/1989 |
| WO | 2008107858 | A1 | 9/2008 |
| WO | 2011098929 | A1 | 8/2011 |

OTHER PUBLICATIONS

European Search Report for corresponding application EP13169256.8, mailed Sep. 10, 2013. 6 pages.
Machine translation of DE102005015305A1 (Oct. 5, 2006), obtained on Dec. 23, 2013. 16 pages.
Machine translation of EP0329644A2, (Aug. 23, 1989), obtained on Dec. 23, 2013. 8 pages.
Machine translation of WO2011098929A1 (Aug. 18, 2011), obtained on Dec. 23, 2013. 1 page.

* cited by examiner

*Primary Examiner* — William Kelleher
*Assistant Examiner* — Duoni Pan
(74) *Attorney, Agent, or Firm* — Leber Patent Law P.C.

(57) ABSTRACT

A system for preventing pressure ulcers, where the system includes one or more actuators, one or more bearings assemblies each including a multiplicity of movable bearings and optionally an enveloping strip operatively associated with the actuator. The bearings can be rotated to allow shifting locations of the bearings in respect to a part of the patient's body laid thereover for changing pressured touch points between the part of the patient's body and the bearings over time for preventing development of pressure ulcers. This is done by moving the patient's body caused by the rotation of the bearings.

17 Claims, 10 Drawing Sheets

SYSTEM AND METHOD FOR PREVENTING PRESSURE ULCERS

CROSS-REFERENCE TO RELATED PATENT APPLICATIONS

This application claims priority to Israeli patent application No. 219995, filed on May 24, 2012, which is incorporated herein by reference in its entirety.

FIELD OF THE INVENTION

The present invention generally relates to systems, treatment beds, apparatuses and methods for preventing pressure ulcers.

BACKGROUND OF THE INVENTION

Pressure ulcers also known as bedsores or decubitus ulcers develop when a patient is forced to lie down or sit for a long period of time without being able to change position. Bedsores are known for being hard to treat and for causing excruciating pain and can cause ischemia, which can lead to tissue necrosis if left untreated. In some cases, if the ulcer extends to a large tissue surface necrosis may be unavoidable. Therefore, people who treat bedridden patients or patients who are required to sit for long periods are very aware of the danger of developing pressure ulcers and how important it is to try and prevent these ulcers from developing.

There are some methods and systems that are currently used to try and prevent pressure ulcers from being developed such as specially designed foam, gel or air-filled cushions or mattresses that can relieve pressure and help ensure that the body is appropriately positioned in the bed/chair or systems that can lift or facilitate a caretaker in lifting the patient into a vertical posture. These methods and systems require caretakers such as the hospital/institute nurses to turn bedridden patients for changing their laying position, change their sheets frequently and lifting those patients to a vertical position. Patients who are bedridden for long periods often gain weight making these tasks even harder to perform and may require more caretakers. Moreover, these methods often cause embarrassment and frustration for the bedridden patients who utterly depend upon others.

SUMMARY OF THE INVENTION

According to some aspects of the invention, there is provided a system for preventing pressure ulcers that includes: (a) at least one bearings assembly comprising multiple bearings, wherein the bearings assembly is configured for allowing a patient to directly or indirectly lay or sit thereover; and (b) at least one actuator for moving the bearings. The bearings are movable by the at least one actuator for moving the respective patient laying thereover, allowing thereby to shift locations of the bearings in respect to a part of the patient's body thereby changing pressured touch points between the part of the patient's body and the bearings over time to prevent pressure ulcers from developing.

Optionally, the actuator is configured for moving the bearings back and forth through a predefined rotational span to allow moving the respective patient back and forth allowing thereby covering a maximal number of touch points per timeframe over a part of the patient's body that interfaces these bearings.

The system may further comprise at least one motor for operating the actuator.

According to some embodiments, the bearings are arranged in rows, in each such row the bearings are connected via an axis, each respective axis connects to a main connecting strap that is rotatable by the at least one actuator, wherein rotation of the connecting strap allows rotation of the bearings. The system optionally comprises a multiplicity of bearings assemblies, wherein each bearings assembly has a different connecting strap for connecting axes of its bearings to a base frame, wherein at least one of the bearings assemblies connects to an actuator that can lift thereof for allowing changing body positioning of the respective patient laying over the bearings assemblies. The connecting straps of each pair of adjacent bearings assemblies may optionally connect to one another via a linking mechanism for allowing using a single actuator for rotating all said connecting strap in a coordinated manner.

According to some embodiments, each such linking mechanism comprises a rotatable chain or strap or a crank, wherein the linking mechanism connects to a respective edge axis of each of the bearings assemblies it links.

Optionally, each bearings assembly is configured for being placed over a different foldable section of a treatment bed, at least one of the sections of the treatment bed can fold in respect to an adjacent section thereof for allowing changing bodily positions of the respective patient laying thereover, wherein once the section is folded the respective said bearings assembly placed thereover can fold therewith.

The system optionally further comprises a controller for controlling operation of each actuator.

According to some embodiments, the system further includes an enveloping strip operatively associated with the actuator, where the enveloping strip covers the bearings in a manner that allows the enveloping strip to interface the respective patient laying thereover while the weight of the patient is applied upon at least some of the bearings through the enveloping strip.

The enveloping strip optionally interfaces the bearings and is rotated by the at least one actuator to allow indirect rotation of the bearings.

The system optionally further includes a movable plate which connects to a part of the enveloping strip, to a base supporting the system, where the actuator enables moving the plate from a first position to a second position, allowing thereby to move the patient's body from one position to another and thereby allowing the bearings to shift their touch points locations interfacing the patient's body.

The system according to claim 9, wherein said at least one actuator comprises a linear motor actuator and connects to an actuator piston for allowing lateral movement of the piston to laterally move said plate for rotating said enveloping strip.

The system according to claim 1 further comprising a base structure connected to a lower side of said at least one bearings assembly for supporting thereof.

The system according to claim 1, wherein said bearings are spherical bearings.

The system according to claim 1, wherein each said bearing is made from a pressure-reducing material.

According to other aspects of the invention, there is provided a method for preventing pressure ulcers including directly and/or indirectly rotating bearings arranged over at least one bearings assembly, wherein the bearings rotation allows shifting locations of the bearings in respect to a part of the patient's body laid thereover thereby changing pressured touch points between the part of the patient's body and the bearings over time for preventing development of pressure ulcers.

Optionally, the bearings are rotated at predefined time intervals.

According to some embodiments, the bearings are rotated by rotating an enveloping strip interfacing the bearings.

Optionally, the patient is moved in a near-continuous manner, wherein the bearings are rotated to one rotational direction continuously during a first predefined time interval and through the opposite rotational direction through a second predefined time interval. According to some embodiments, a third pause time interval is predefined for switching the actuator from one rotational direction to another.

DETAILED DESCRIPTION OF SOME EMBODIMENTS OF THE INVENTION

Figure 1:
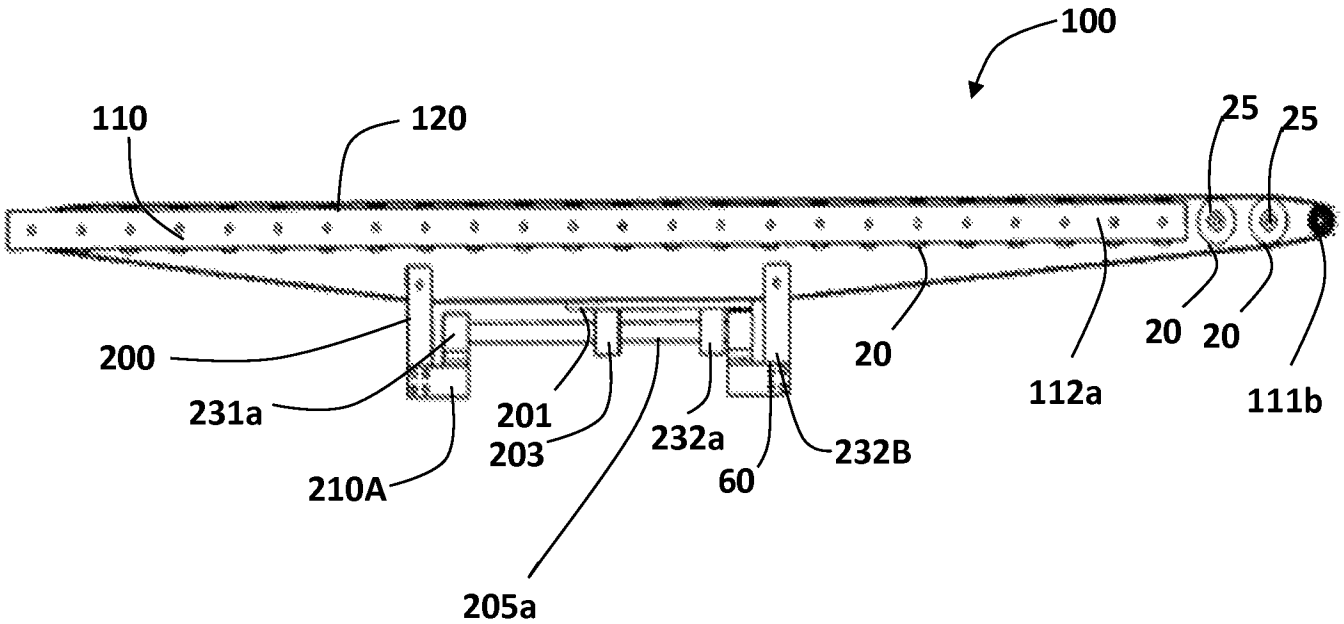
FIG. 1 shows a side view of a system for preventing pressure ulcers, according to some embodiments of the present invention.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides systems and methods for preventing pressure ulcers for bedridden patients or any other patients that are forced to either lay or sit for long periods of time. According to some embodiments of the present invention, the systems and methods use rotatable bearings arranged over one or more bearings assemblies, where a patient is laid over the bearings in a manner that allows at least some of the bearings to apply pressure over body parts of the laid patient interfacing therewith and shift touch points over which the pressure is applied over time. The bearings are automatically rotatable and therefore significantly reduce the man power required to continuously move the bedridden patient to prevent him/her from developing pressure ulcers. This is carried out by using a system, which can be designed as a treatment bed, including a bearings assembly over which spherical or wheel like bearings are arranged, where the bearings either directly or indirectly interface the patient's body to move thereof. The rotation of the bearings interfacing the patient moves the body of the patient (who is often unable to move himself/herself) and thereby the touching/pressure points change location in respect to the patient's body over time, allowing preventing the patient's blood-flow from being interrupted, weakened and/or stopped, and thereby preventing pressure ulcers (also known as bedsores) from developing.

The size and configuration of each of the bearings as well as their arrangement over the bearings assembly (e.g. in rows that interface one another) allow optimally shifting touch points between the bearings and the patient's body in a continuous manner, providing a system that can efficiently prevent pressure ulcers.

The system simply moves the patient either continuously or at very short time-intervals from one position to another by rotating the bearings in a respective continuous or near-continuous manner to shifts the touch points, which are the locations upon which the pressure of the bearings is applied over the patient body part interfacing thereof. This allows pressuring one point at each given moment, while relieving an adjacent point, which was recently touched in a continuous or near-continuous manner.

The term near-continuous indicates that the bearings are moved at predefined or controlled time intervals, where those time-intervals are short enough to allow efficiently preventing developing of pressure ulcers. These time-intervals are set according to a calculation that optimizes the efficiency of the system, where the calculation depends, inter alia, in the dimensions of a respective bearing and bearings assembly in respect to a target patient size and weight. For example, the optimal number and size of the bearings as well as the distance between each two adjacent bearings may be different for patients of certain weight and/or height ranges and/or age range than of a different one or more of these age/weight/height ranges.

Figure 2:
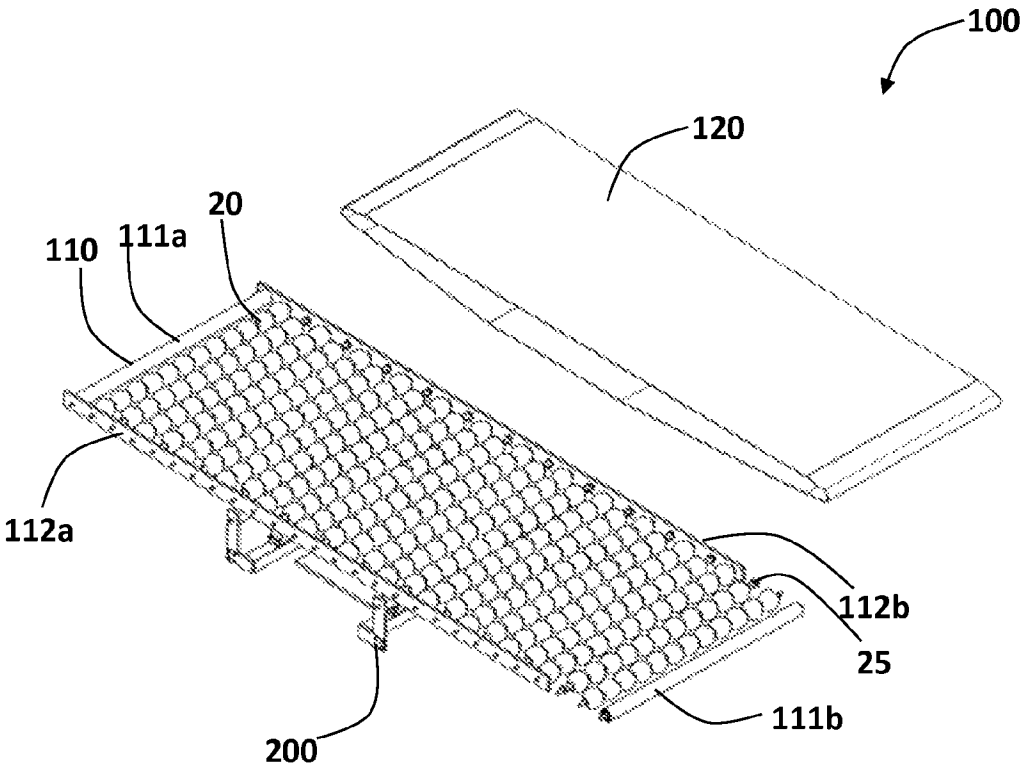
FIG. 2 is an exploded isometric view of the system, according to the embodiments illustrated in FIG. 1.

Reference is now made to FIGS. 1-2, schematically illustrating a system 100 for preventing pressure ulcers, according to some embodiments of the present invention. The system 100 includes: (i) a base 200 having base legs 210A and 210B; (ii) a bearings assembly 110 mounted on the base 200, where the bearings assembly includes a multiplicity of movable spherical bearings 20 arranged in rows, where each row of bearings 20 is pivotally held by a respective axel 25; (iii) an enveloping strip 120, enveloping the bearings assembly 110 through the base 200 in a manner that allows the upper part of the strip 120 to interface (touch) the bearings 20 when the patient is laid thereover; (iv) a linear actuator 60 enabling to rotate the enveloping strip 120 and thereby to rotate the spherical bearings 20 over their axels 25; and (v) a controller 70 which connects to the actuator 60 for operating and controlling thereof.

The actuator 60 may include a linear motor actuator connected to a piston 61 that can push a movable plate 201 connected to the base 200 between two positions and/or between two limiting stoppers that define the back-and-forth span of the movement of the plate 201 for rotating the enveloping strip 120. The rotation of the enveloping strip 120 rotates the interfacing bearings 20 and thereby move the body of the patient laying thereover from position to position thereby enabling to shift the pressure applied upon each touch point over the patient body parts interfacing the upper surface of the strip 120 at each given moment (or time interval) the pressure of each given bearing 20 is applied upon a different spot (touch point) over the patient's interfacing body part (e.g. the patient's back).

Figure 4A:
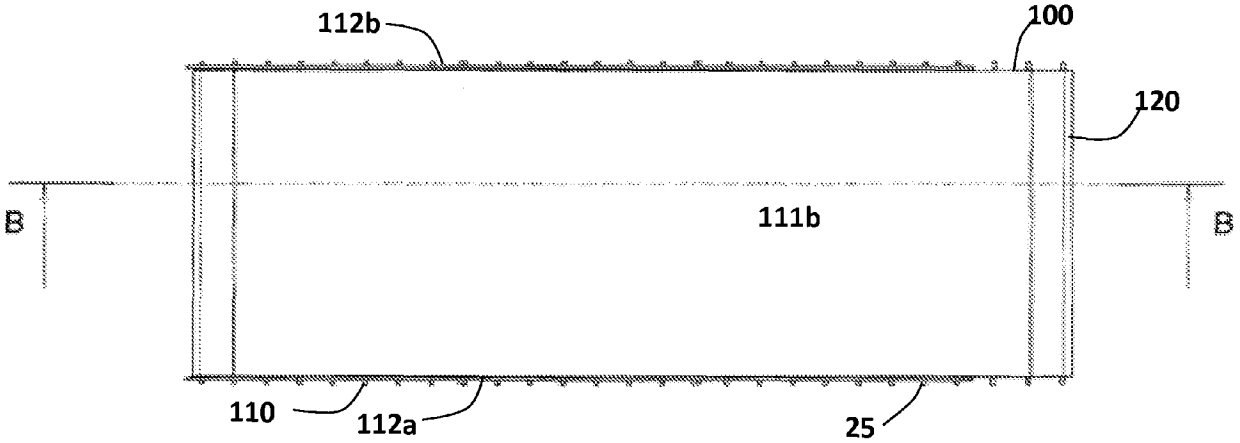
FIG. 4A shows an elevated view of the system, according to the embodiments illustrated in FIG. 1.
Figure 4B:
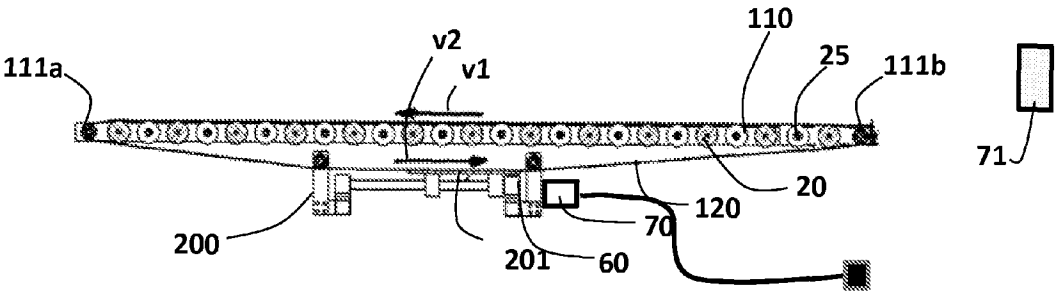
FIG. 4B shows a cross sectional side view of the system, according to the embodiments illustrated in FIG. 1.

As illustrated in FIG. 1 the bearings assembly 110 includes two longitudinal frame bars 112*a* and 112*b* and two rotational bars 111*a* and 111*b* framing the longitudinal bars 112*a* and 112*b*. FIGS. 4A and 4B show how the enveloping strip 120 wraps the upper part of the bearings assembly 110 and connects to the plate 201. The enveloping strip 201 is a closed looped layer of a substantially elastic material such as fabric, polymeric elastic strip, and the like that can be rotated in one rotational direction v1 and the opposite one v2 for rotation the bearings 20 thereby in respective opposite rotational directions. This enables, as mentioned above, moving the patient's body from one position to another and thereby to shift touch/pressure points between the patient's body and the bearings 20 interfacing his/her body.

The controller 70 may connect to a power supply e.g. by connecting to a main electricity line and/or by operating on its own chargeable generator/battery. As illustrated in FIG. 4B, for example, the controller may supply the power to the actuator 60. Alternatively, each may be connected to a power supply separately while connecting to one another to allow the controller 70 to control the actuator 60.

It is further illustrated in FIG. 4B how the controller 70 and/or the actuator 60 can be operated from remote through the use of a remote controller 71 using any technique known in the art for allowing wired or wireless communication therebetween (e.g. infrared, radio frequency, etc.).

Figure 5A:
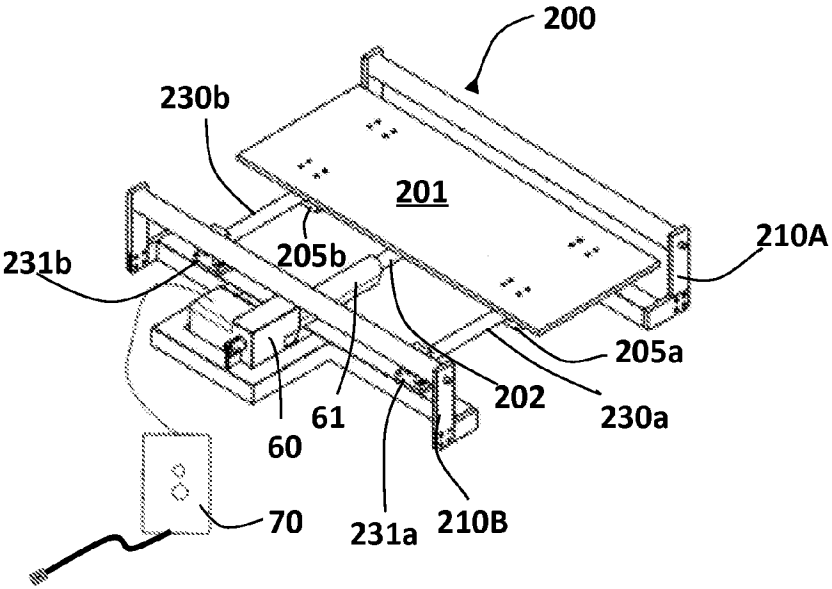
FIG. 5A shows an isometric elevated view of a base section of the system including a movable plate and a linear actuator piston connected thereto in a first movement position, according to some embodiments of the present invention.
Figure 5B:
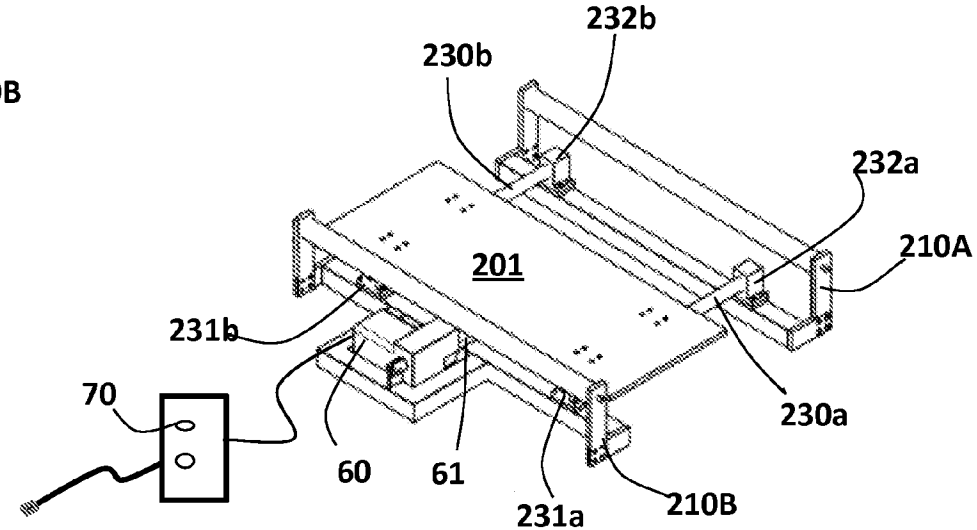
FIG. 5B shows an isometric elevated view of the base section of the system including the movable plate and the actuator piston in a second movement position, according to some embodiments of the present invention.

FIG. 5A shows the base 200 part of the system 100 showing how the plate 201 connects to the piston 61 of the liner motor actuator 60 through bar 202 that allows pushing the plate 201 back and forth from a first position shown in FIG. 5A to a second position shown in FIG. 5B. The span of the plate 201 movement is defined by the distance between two or more limiting edge stoppers such as stoppers 231, 231*b*, 232*a* and 232*b*. The actuator 60 and therefore the piston 61 are controlled by the controller 70, which can be set to a single operation allowing only on/off operations by a user of the system 100 such as a caretaker of the patient. In this case the rotation may be substantially continuous shifting the piston's 61 pushing/pulling direction upon reaching the stoppers (231, 231*b*, 232*a* and 232*b*) of motion and thereby enabling to rotate the enveloping strip 120 to one direction through a first time interval "Δt1" for rotating the bearings 20 in a first rotation direction throughout that time interval "Δt1" and to another strip 120 and therefore bearings 20 rotational direction throughout another time interval "Δt2". A pause of "Δt3" may be necessary for mechanically switching from one direction to another.

As illustrated in FIGS. 5A and 5B, the stoppers 231, 231*b*, 232*a* and 232*b* are located over holding bars 230*a* and 230*b* enabling to place the movable plate 201 thereover and holding thereof The plate 201 may simply be moved over these bars 230*a* and 230*b* or slide therethrough via slidable members (Not shown) to reduce the friction therebetween.

Figure 3:
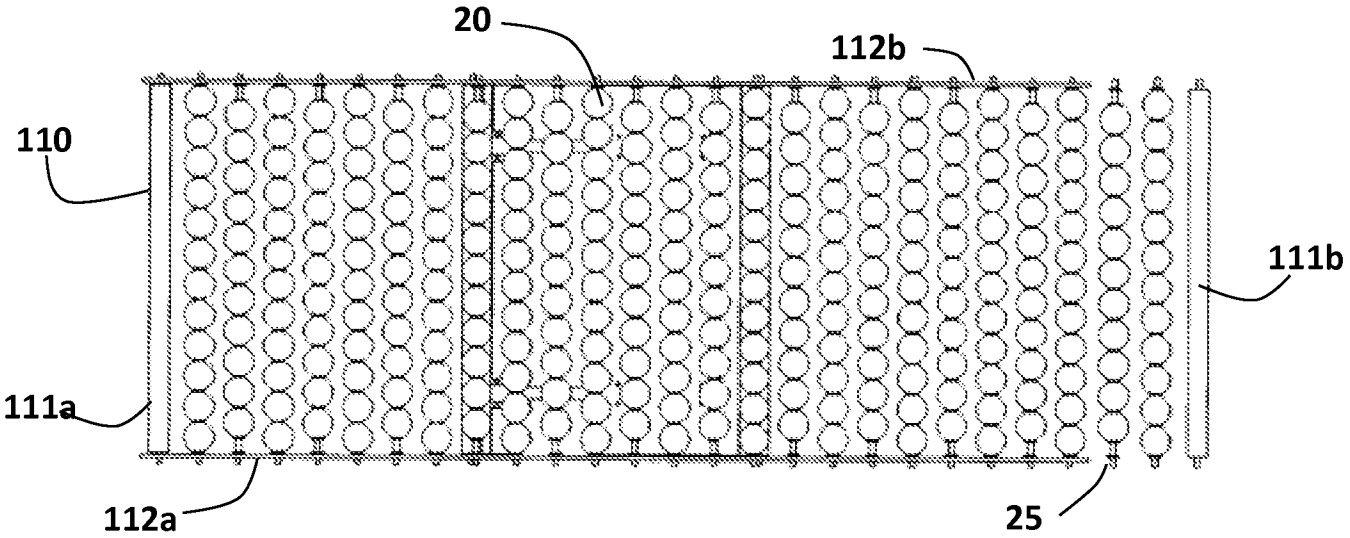
FIG. 3 shows a bearings assembly of bearings of the system, according to the embodiments illustrated in FIG. 1.
Figure 6A:
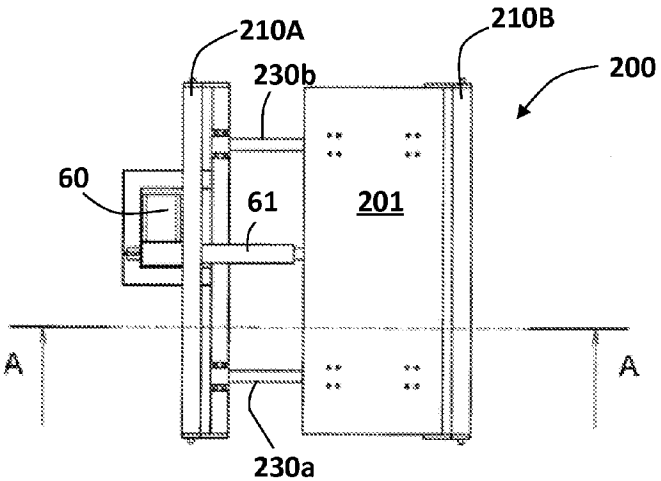
FIG. 6A shows a top view of the base, plate and actuator piston connected thereto in the first position, according to some embodiments of the present invention.
Figure 6B:
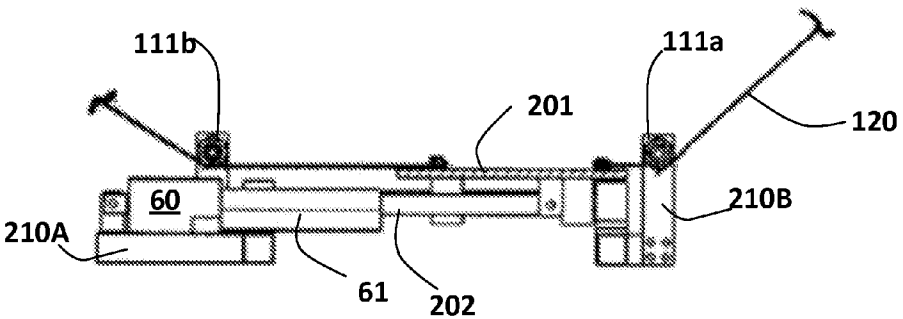
FIG. 6B shows a cross sectional view of the base section in the first position, showing how in this first position the piston is at a maximal push position, according to some embodiments of the present invention.
Figure 7A:
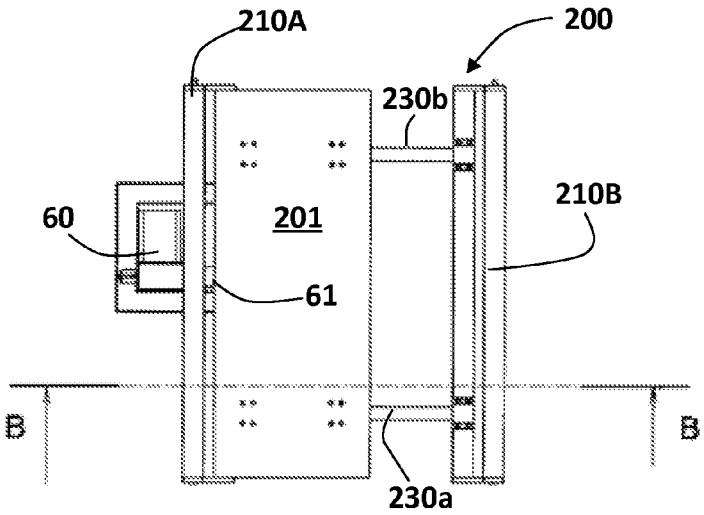
FIG. 7A shows a top view of the base, plate and actuator piston connected thereto in the second position, according to some embodiments of the present invention.
Figure 7B:
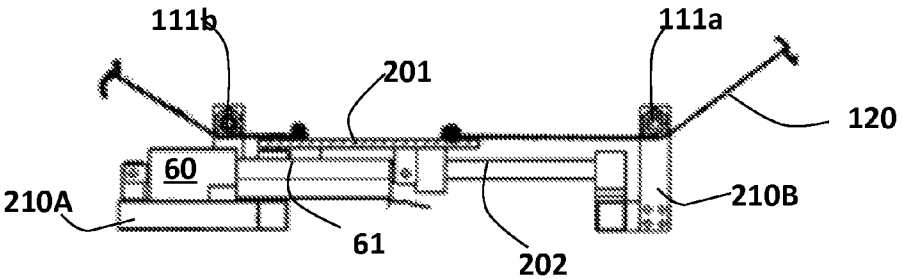
FIG. 7B shows a cross sectional view of the base section in the first position, showing how in this second position the piston is at a maximal pull position, according to some embodiments of the present invention.

FIG. 6A shows an elevated view of the base 200 and plate 201 in a first rotation position/limit and indicates the location of crossing A-A of the cross sectional view of FIG. 6B. FIG. 6B shows the plate 201 in the first position, in which it reached the limit of the stoppers 232*a* and 232*b*. The enveloping strip 120 is arranged under the rotatable bars 111*a* and 111*b* for allowing rotation thereof In the first position of the plate 201 the piston 61 is at its maximal pull position. Correspondently, FIG. 7A shows an elevated view of the base 200 and plate 201 in a second rotation position/limit and indicates the location of crossing B-B of the cross sectional view of FIG. 7B. FIG. 7B shows the plate 201 in the second position, in which it reached the limit of the stoppers 231*a* and 231*b*. In the second position of the plate 201 the piston 61 is at its maximal push position The strip 120 rotates the spherical bearings 20 over their axels 25 to allow shifting their touch points locations in respect to the patient's body to efficiently do so, the bearings 20 rows may be arranged in a substantially dense arrangement, in which, as shown in FIGS. 2-3, the space between each pair of adjacent bearings 20 is calculate to allow relief space, in which a touch point that has recently been pressure would not be pressured again at least in the next time interval.

The dimensions, shape and size of the bearings 20 may be also designed to provide optimal efficiency of the system 100. The bearings 20 may be made of pressure-reducing materials that have a certain degree of elasticity to prevent them from applying too much pressure over the touch points. For example, the bearings 20 may be made of polymeric "foamy" elastic materials, rubber, and the like.

As illustrated in FIGS. 1-2 and 4A-4B, the enveloping strip 120 completely covers the bearings 20 area in a manner that allows this strip 120 to interface a respective patient laying thereover while the weight of the patient is applied upon at least some of the bearings 20. In this particular bed configuration the dimensions of the bearings assembly 110 may allow a standard-size human patent to lay thereover.

In other implementations of the present invention, the same method may be used for sitting postured patients where the design of the bearings assembly 110 is smaller and fits the seat of the sitting apparatus of the patient (such as designed as a chair seat)

According to other embodiments of the present invention, the system may not include an enveloping strip, where the bearings can come in direct contact with the patient body part (e.g. back) where the actuator or any other automotive mechanism controls and operates the movement of these bearings directly.

Figure 8:
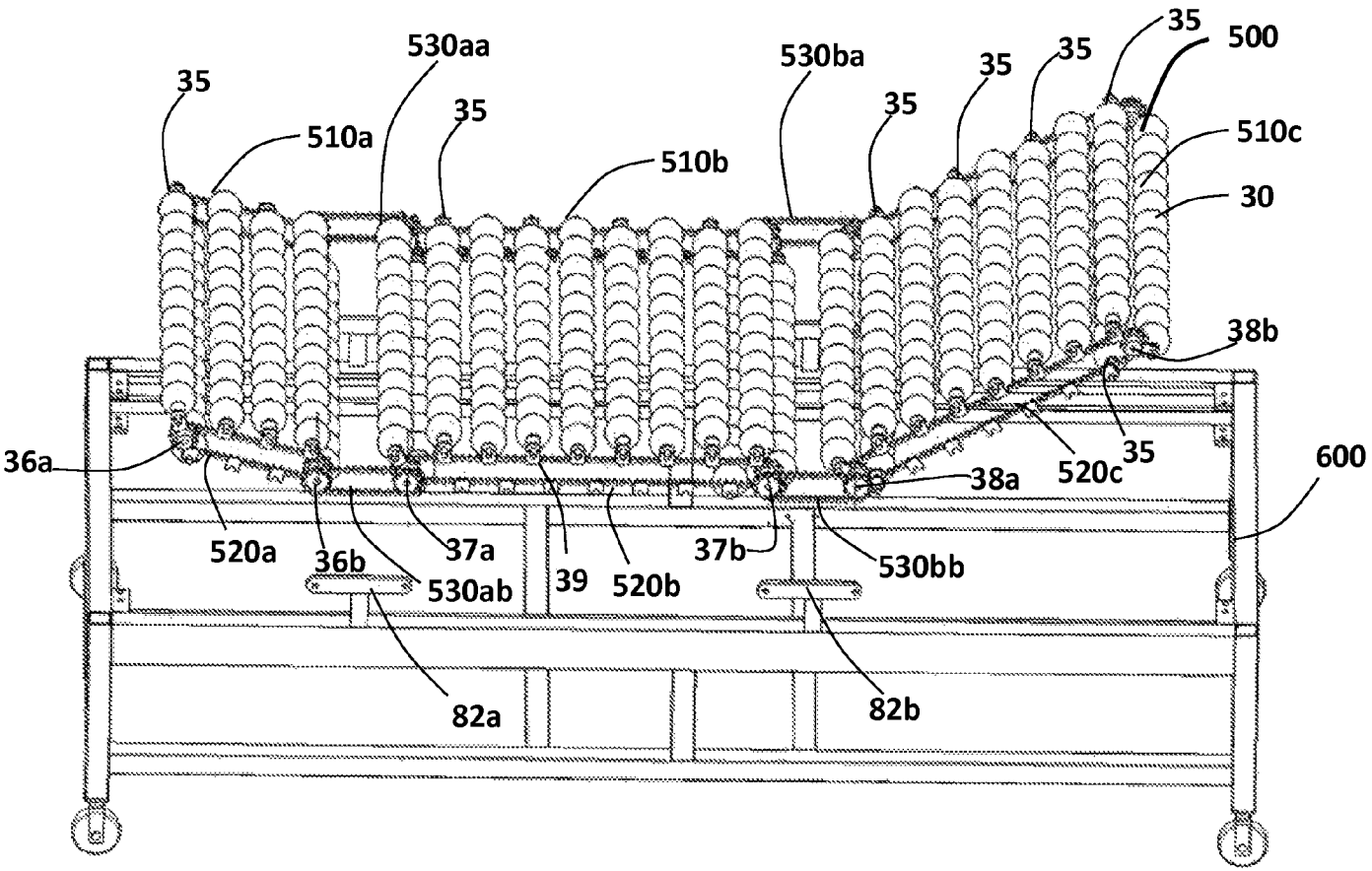
FIG. 8 shows a schematic illustration of a system for preventing pressure ulcers, according to other embodiments of the present invention that is placed over a supporting base of a treatment bed that has multiple foldable sections.
Figure 9A:
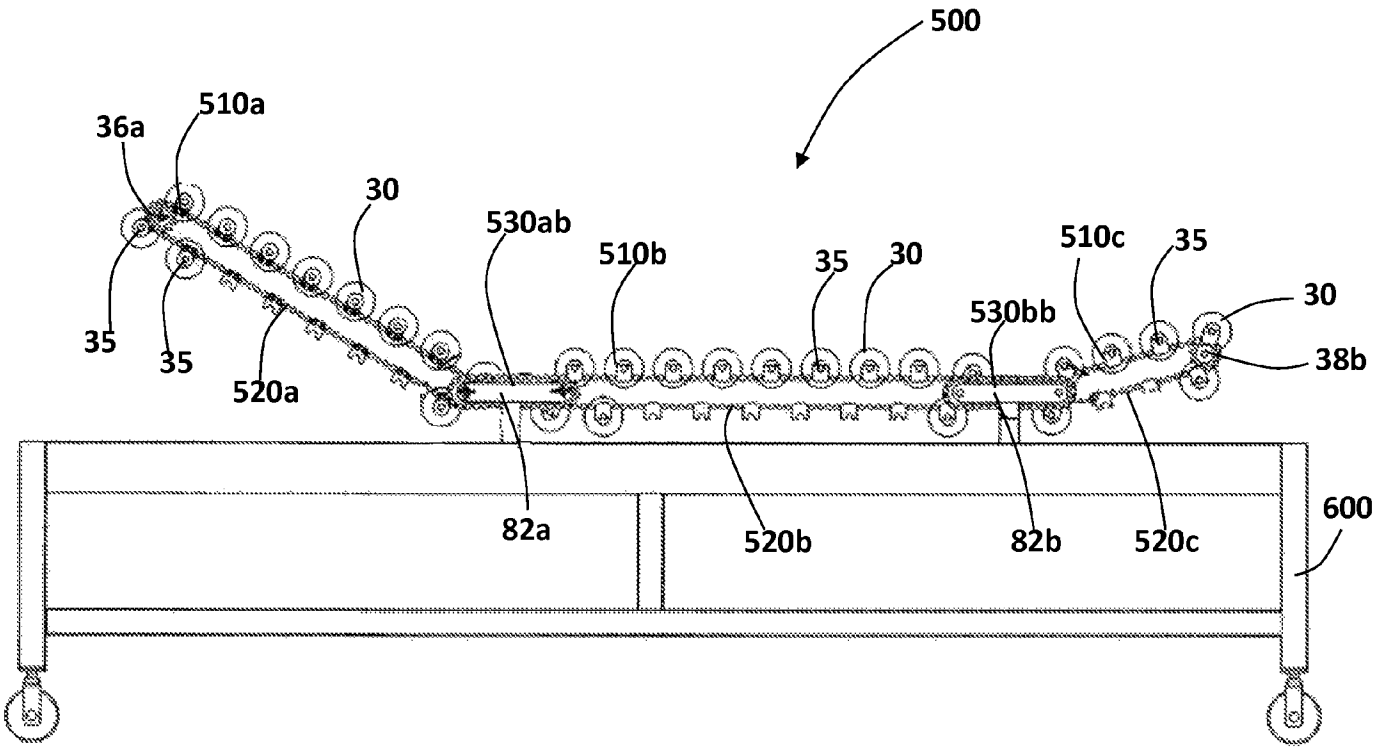
FIG. 9A shows a side view of the system illustrated in FIG. 8.
Figure 9B:
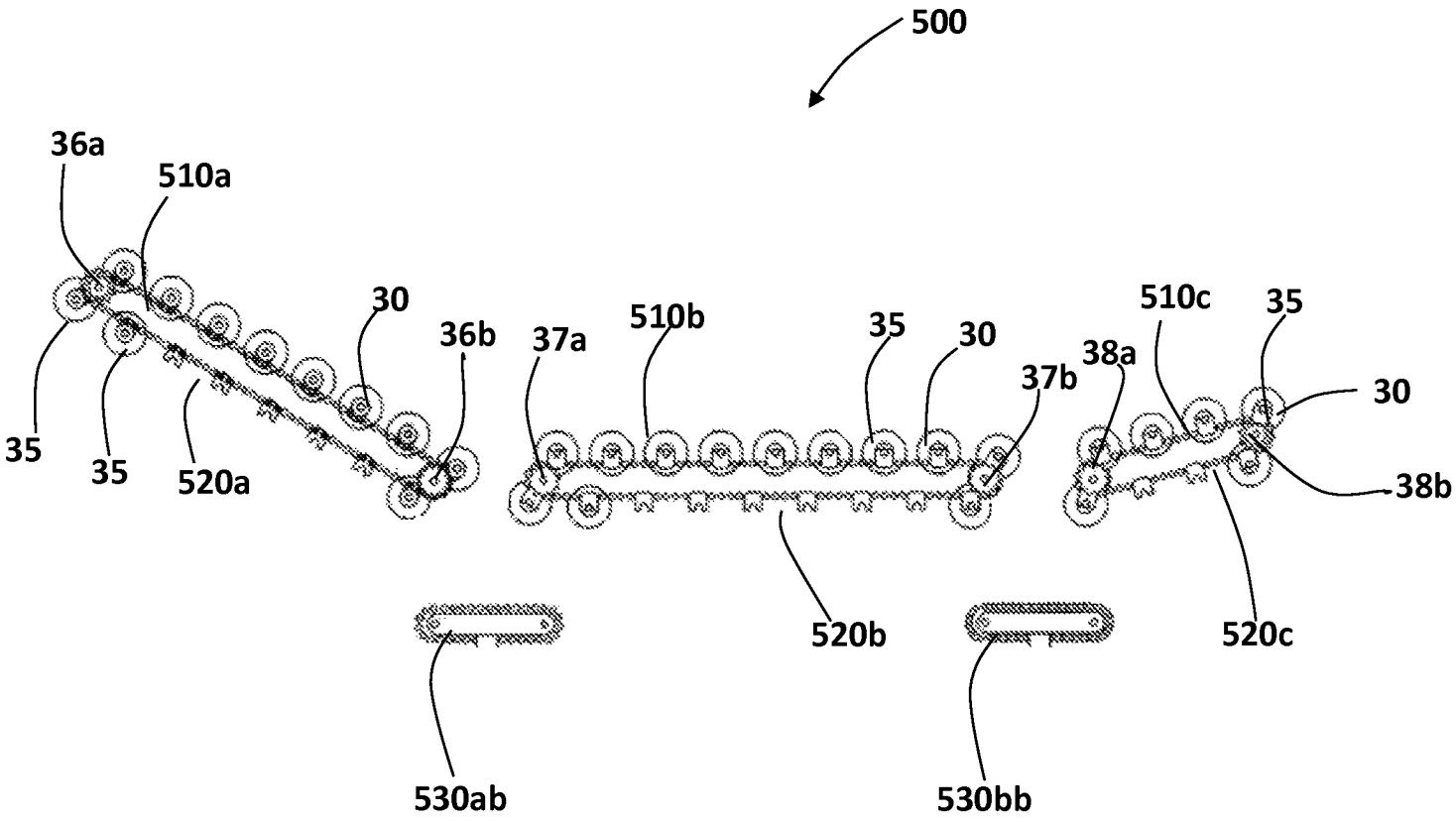
FIG. 9B shows an exploded side view of the system illustrated in FIG. 8.

Reference is now made to FIGS. 8, 9A and 9B, schematically illustrating a system 500 for preventing pressure ulcers having multiple and foldable bearings assemblies, according to other embodiments of the present invention. According to these embodiments, the system 500 includes three bearings assemblies 510*a*, 510*b* and 510*c* where the two external assemblies 510*a* and 510*c* be rotated (folded) one against the other to allow placing the assemblies 510*a*-510*c* over a multi-sectional treatment bed-support for allowing changing bodily positions of a respective patient laying thereover. The bearings assemblies 510*a*-510*c* may movably connect to one another via linking mechanisms such as via rotatable chains/straps or cranks In this case the assemblies 510*a*-510*c* connect to one another via rotatable chains 530*aa*, 530*ab*, 530*ba* and 530*bb*. Each such rotatable chain 530*aa*, 530*ab*, 530*ba* or 530*bb* is anchored to the bed-support 600 via an anchoring member such as anchoring members 82*a* and 82*b* (where anchoring members anchoring rotatable chains 530*aa* and 530*ba* are not shown due to the perspectives of FIGS. 8 and 9A-9B). The entire set of rotatable chains 530*aa*-530*bb* and bearings assemblies 510*a*-510*b* can be moved by a single actuator (not shown) since they are linked via rotatable components. Each bearings assembly 510*a*-510*c* may additionally include strap axels such as axels 36*a*, 36*b*, 37*a*, 37*b*, 38*a* and 38*b* some connect to the linking chains 530*aa*-530*bb* and some (optionally axels 36*a* and 38*b*) may connect to the one or more actuators rotating all the assemblies 510*a*-510*c* in coordinated manner (simultaneously).

According to some embodiments, as illustrated in FIGS. 8-9B, each bearings assembly 510*a*/510*b*/510*c* includes rows of bearings 30 connecting to a rotatable connecting strap 520*a*/520*b*/520*c*, respectively. Each row is mounted onto a bearings axis 35 for enabling the bearings 30 to rotate thereabout. Each bearings axis 35 connects to the connecting strap 520*a*/520*b*/520*c* of its respective bearings assembly 510*a*/510*b*/510*c* via a connector 39. The straps 520*a*/520*b*/520*c* are rotated for a predefined one or more optional rotation spans such as back and forth for a respectively small span of a few centimeters for allowing rotating the spherical bearings 30 back and forth for a corresponding rotational span. The rotation of the bearings 30 will move a patient laying thereover slightly back and forth changing the interfacing touch points between the bearings 30 and the part(s) of the patient's body for applying controlled pressure over these parts in a varying continuous manner to prevent the patient from developing pressure ulcers.

In the examples illustrated in FIGS. 8-9B the bed support 600 is not adjustable/foldable, however the configuration of the system 500 is adapted to adjustable bed or bed supports such as treatment beds having multiple sections where two adjacent sections can be rotated/folded one against the other for adjusting laying/sitting position of the patient. In case of treating bedridden patients, allowing the system 500 to be adjustable for allowing placing it over an available hospital adjustable treatment bed or bed support, tremendously improves treatment and also allows using available hospital beds or bed support without requiring building a special treatment bed, which may substantially reduce costs. The anchoring members 82*a*-82*b* can be easily attached to an available bed support via attaching means known in the art such as by screwing the anchors to the bed support.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

What is claimed is:

1. A system for preventing pressure ulcers, said system comprising:

a) at least one bearings assembly comprising multiple spherical bearings;

b) at least one actuator for directly or indirectly rotating said spherical bearings back and forth; and c) a controller for controlling said actuator, said controller being configured for controlling time intervals between back and forth rotations of said spherical bearings, wherein said spherical bearings are directly or indirectly movable by said at least one actuator for moving the respective patient laying thereover, allowing thereby to shift locations of the bearings in respect to the patient's body while the patient is laying thereover, for changing pressured touch points between the patient's body and said spherical bearings over time for treating or preventing pressure ulcers.

2. The system according to claim 1 further comprising at least one motor for operating said actuator, said motor being controllable by said controller.

3. The system according to claim 1, wherein said spherical bearings are arranged in rows, in each said row the bearings are connected via an axis, each respective axis connects to a main connecting strap that is rotatable by said at least one actuator, wherein rotation of said connecting strap allows rotation of said bearings.

4. The system according to claim 1, wherein said at least one bearings assembly comprises a multiplicity of bearings assemblies, wherein each bearings assembly has a different connecting strap for connecting axes of its spherical bearings, wherein at least one of said multiplicity of bearings assemblies connects to an actuator that fold and unfold thereof for allowing changing body positioning of the respective patient laying over said bearings assemblies.

5. The system according to claim 4, wherein said connecting straps of each pair of adjacent bearings assemblies connect to one another via a linking mechanism for allowing using a single actuator for rotating all said connecting strap in a coordinated manner.

6. The system according to claim 5, wherein each said linking mechanism comprises one of: a rotatable chain or strap, wherein said linking mechanism connects to a respective edge axis of each of the bearings assemblies it links.

7. The system according to claim 6 further comprising a movable plate, said at least one actuator enables moving said plate from a first position to a second position thereby rotating the enveloping strip back and forth, allowing thereby to move the patient's body from one position to another and thereby shifting the touch points locations between the patient's body and said spherical bearings via said enveloping strip.

8. The system according to claim 7, wherein said at least one actuator comprises a linear motor actuator and connects to an actuator piston for allowing lateral movement of the piston to laterally move said plate for rotating said enveloping strip.

9. The system according to claim 4, wherein each bearings assembly is configured for being placed over a different foldable section of a treatment bed, at least one of the sections of said treatment bed can fold in respect to an adjacent section thereof for allowing changing bodily positions of the respective patient laying thereover, wherein once said section is folded the respective said bearings assembly placed thereover can fold therewith.

10. The system according to claim 1 further comprising an enveloping strip operatively associated with said at least one actuator, said enveloping strip covers said bearings assembly in a manner that allows said enveloping strip to interface the respective patient laying thereover once the weight of said patient is applied upon said spherical bearings through said enveloping strip, wherein said actuator is configured for moving said enveloping strip for having the weight of the patient laying thereover rotate said spherical bearings upon moving of said enveloping strip.

11. The system according to claim 1 further comprising a base structure connected to a lower side of said at least one bearings assembly for supporting thereof.

12. The system according to claim 1, wherein each said spherical bearing is made from an elastic polymer or rubber.

13. A method for preventing pressure ulcers, said method comprising:

a) directly and/or indirectly rotating spherical bearings arranged over at least one bearings assembly, said spherical bearings rotation allows moving a body of a patient laying thereover for changing pressured touch points between the patient's body and said bearings over time for treating or preventing development of pressure ulcers; and b) controlling back and forth rotation of said spherical bearings, by controlling time intervals between back and forth rotations of said spherical bearings, using a controller.

14. The method according to claim 13, wherein said controlling includes determining time intervals according to which said spherical bearings are directly or indirectly rotated.

15. The method according to claim 13, wherein said bearings are rotated by rotating an enveloping strip interfacing said bearings.

16. The method according to claim 13, wherein said patient is moved in a near-continuous manner, wherein said bearings are rotated to one rotational direction continuously during a first predefined time interval and through the opposite rotational direction through a second predefined time interval.

17. The method according to claim 16, wherein a third pause time interval is predefined between said first and second time intervals, for switching the actuator from one rotational direction to another.

* * * * *